US005503195A

United States Patent [19]

Edens, Jr.

[11] Patent Number: 5,503,195

[45] Date of Patent: Apr. 2, 1996

[54] COMBINATION-TYPE SEAMING PINTLES WITH WIRE LEADER

[75] Inventor: Roy C. Edens, Jr., Moncks Corner, S.C.

[73] Assignee: Albany International Corp, Albany, N.Y.

[21] Appl. No.: 339,935

[22] Filed: Nov. 15, 1994

[51] Int. Cl.[6] ..... D03D 13/00; D03D 15/00

[52] U.S. Cl. ..... 139/383 AA; 24/573.7

[58] Field of Search ..... 29/433; 24/573.7; 139/383 AA; 162/199, 200, 348, DIG. 1

[56] References Cited

U.S. PATENT DOCUMENTS

| | | | |
|---|---|---|---|
| 4,103,717 | 8/1978 | Clark | 139/383 AA |
| 4,144,911 | 3/1979 | Veith . | |
| 4,186,780 | 2/1980 | Josef et al. . | |
| 4,195,549 | 4/1980 | Schuster et al. | 87/1 |
| 4,362,776 | 12/1982 | Lefferts et al. . | |
| 4,415,625 | 11/1983 | Borel | 29/433 |
| 4,438,789 | 3/1984 | MacBean . | |
| 4,500,590 | 2/1985 | Smith . | |
| 4,755,260 | 7/1988 | Sakuma . | |
| 4,806,208 | 2/1989 | Penven | 139/383 AA |
| 4,824,525 | 4/1989 | Penven . | |
| 4,842,212 | 6/1989 | Loiselle et al. | 242/405 |
| 4,842,925 | 6/1989 | Dufour et al. . | |
| 4,863,786 | 9/1989 | Green et al. . | |
| 4,883,096 | 11/1989 | Penven | 139/383 AA |
| 4,902,383 | 2/1990 | Penven . | |
| 4,958,673 | 9/1990 | Dufour . | |
| 5,053,109 | 10/1991 | Penven . | |
| 5,238,027 | 8/1993 | Lee . | |

FOREIGN PATENT DOCUMENTS

| | | |
|---|---|---|
| WO92/11412 | 7/1992 | WIPO . |

*Primary Examiner*—Andy Falik

*Attorney, Agent, or Firm*—Kane, Dalsimer, Sullivan, Kurucz, Levy, Eisele & Richard

[57] ABSTRACT

A composite pintle for joining the ends of a pin-seamable papermaker's fabric together with a pin seam includes a monofilament yarn having at least one monofilament strand, and a filler yarn, so-called because it fills the void volume surrounding the monofilament yarn in the passage formed by the interdigitated seaming loops and through which the composite pintle is directed to join the fabric into endless form. The filler yarn, including sample fibers, may be a texturized, spun, cabled or plied yarn. The monofilament and filler yarns are drawn through the seaming passage by a wire leader, which may be attached to them by a connecting sleeve.

10 Claims, 2 Drawing Sheets

COMBINATION-TYPE SEAMING PINTLES WITH WIRE LEADER

BACKGROUND OF THE INVENTION

1. Field of the Invention

The present invention relates to the fabric belts used on papermaking machines to support, carry and dewater a wet fibrous web as it is being processed into paper. More particularly, it relates to seamed, rather than endlessly woven, fabrics and to the joining of the two ends of a pin-seamable fabric to one another to form an endless belt on a papermachine.

2. Description of the Prior Art

Endless fabric belts are key components of all three sections (forming, pressing and drying) of the machines on which paper is manufactured. There, like a conveyor belt, they carry a wet fibrous web along as it is being processed into paper. At the same time, they provide needed support to the fragile wet paper web and dewater it by accepting water which drains or is pressed therefrom.

Generally, these fabrics are supplied either in endless form, that is, woven in the form of an endless loop without a seam, or in open-ended form. The later must be closed into endless form when installed on the papermachine. This will require a seam running in a substantially transverse direction across the fabric at the point where the two ends meet.

The so-called OMS (on-machine-seamed) fabrics are much easier to install on a papermachine position than those of the endlessly woven variety. To do so, one must draw one end of the open-ended fabric through the machine and around the relevant guide and tension rolls and other components. Then, the two ends may be joined to each other at a convenient location on the machine and the tension adjusted to make the fabric taut. In practice, a new fabric is often installed at the time a used one is being removed by connecting one end of the new fabric to the used fabric, which can then be used to pull the new fabric into proper position on the machine.

Alternatively, a rope, or ropes, may be attached to one end of a fabric being replaced. When the other end of the used fabric is pulled out to remove it from the machine, the rope, or ropes, is drawn about the path formerly occupied by the fabric. This approach enables plant personnel to clean machine components before the new fabric is installed. To complete the entire operation, one end of the rope is attached to the leader of the new fabric, while the other end is pulled to draw the fabric onto the machine position.

The closure of a commonly used variety of seams will be our primary concern here. The seams of interest are commonly referred to as pin seams. By deliberate design, it is more difficult to distinguish from the main body of the fabric than seams formed in other ways. The seam region in a fabric closed with a pin seam more closely resembles the main body of the fabric, in terms of such parameters as permeability, than the seam regions in fabrics seamed in other ways.

A pin seam can be quite difficult to close. To do so, a thin cable, known as a pintle, is directed through a tubular passage formed by the interdigitation of the seaming loops provided at the two ends of the fabric. The seaming loops in an OMS fabric are formed by the machine-direction, or longitudinal, body yarns of the fabric.

Typically, the pintle will be attached to a wire leader by means of a connecting sleeve. The leader, because of its stiffness relative to that of the pintle, will be directed through the tubular passage first, and used to pull the pintle therethrough as a needle may be used to pull a thread.

The pintle itself may be a monofilament extruded from any of the synthetic polymeric resin materials used in the manufacture of the papermachine clothing. Such a pintle may have either a round (circular) or flattened (elliptical) cross section. Alternatively, the pintle may take any one of the other forms commonly taken by the yarns used in the weaving of papermachine clothing; that is to say, pintles may take the forms of braided or plied monofilament yarns, multifilament yarns or spun yarns, and so forth.

Even after a pintle has been installed, it remains necessary to ensure that the seam region has the same properties, in terms of permeability and compressibility, as the main body of the fabric, so that the seam region will not "mark" the paper sheet being manufactured. At the very least, marking of this sort is aesthetically undesirable; at worst, the mark represents a weakness in the sheet susceptible to breakage. In addition, where the permeability of the seam region is different from that of the main body of the fabric, an extremely loud "popping" noise may be generated each time the seam region passes over a suction box. One of ordinary skill in the art would readily acknowledge such persistent and repetitious "popping" to be an annoyance.

Stuffer yarns are frequently used to provide the seam region with permeability and compressibility comparable to those of the main body of the fabric. In the past, stuffer yarns have been installed separately following the installation of the pintle to fill in any void volume remaining around the pintle in the passage formed by the interdigitated seaming loops. Typically, the stuffer yarns have their own leader, but this must be fed or directed through the passage already occupied by the pintle itself. Quite often, the seaming loops themselves are damaged in the course of this separate operation.

The present invention is designed to permit the simultaneous installation of both pintle and stuffer yarn to reduce and optimally to eliminate the occurrence of seaming loop damage during the seaming operation.

SUMMARY OF THE INVENTION

Accordingly, the present invention is a composite pintle for joining the ends of a pin-seamable papermaker's fabric to one another with a pin seam.

The composite pintle comprises a first pintle member which is a yarn of the variety commonly used for pintles by those of ordinary skill in the papermaking arts. That is to say, the first pintle member is a monofilament yarn comprising at least one monofilament strand, and may therefore be a single monofilament strand, a plurality of such strands, or a plied monofilament yarn. A monofilament is a single, generally coarse filament of man-made textile fiber. A plied monofilament yarn is a yarn formed by twisting together two or more monofilament strands in a single operation.

The composite pintle also comprises a filler yarn comprising staple fibers. The filler yarns is intended to replace the stuffer yarns heretofore separately installed in the pin seam after the pintle is in place. The filler yarn may be texturized, spun, cabled or plied yarn, and is included to fill in the void area around the pintle in the connecting loops of the seam to reduce seam marking. A texturized yarn is a continuous filament man-made fiber yarn which has been crimped, curled, coiled or otherwise distorted so as to be provided with bulk and texture. A spun yarn is a yarn formed by spinning fiber strands of relatively short length together.

A cabled yarn is a yarn made with a cable twist, wherein plies are twisted together in a direction opposite to their individual twist to provide a balanced yarn. A plied yarn is a yarn formed by twisting together two or more strands in a single operation, and may also be formed by twisting together two or more plied members.

The composite pintle further comprises a wire leader, which is first directed through the passage formed by the interdigitated seaming loops and used to pull the first and second pintle members therethrough in the manner of a needle and thread.

Means are provided in the composite pintle for connecting the wire leader to the first and second pintle members. Those means may be a single connecting sleeve, although one or more additional connecting sleeves and secondary wire leaders may be used to achieve the same end.

The present invention will now be described in more complete detail with frequent reference being made to the several drawing figures identified as follows.

DETAILED DESCRIPTION OF THE PREFERRED EMBODIMENT

Figure 1:
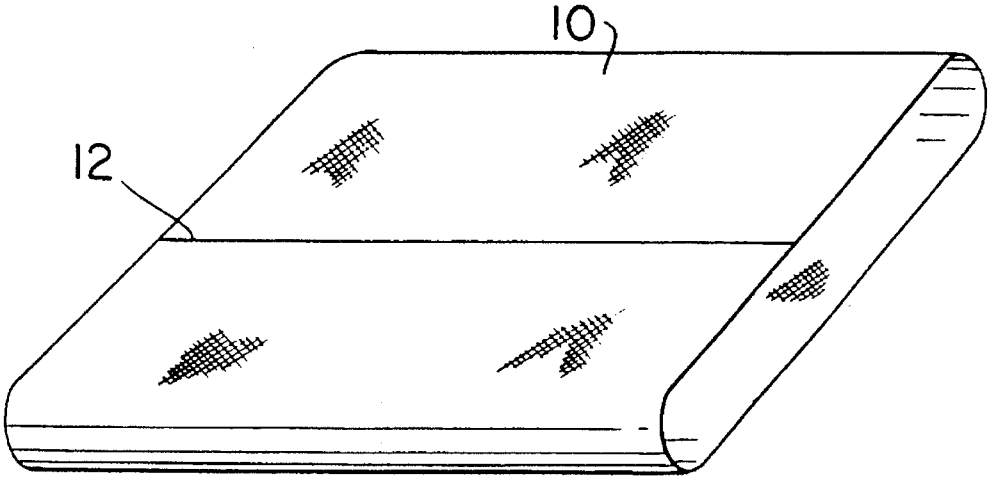
FIG. 1 is a perspective view of a seamed papermaking fabric.

Turning now to the accompanying figures, FIG. 1 is a perspective view of a papermaker's fabric 10 of the on-machine-seamed (OMS) type. The fabric 10, originally in open form, has been closed into endless form by the seam 12 which joins the two ends of the fabric 10.

Figure 2:
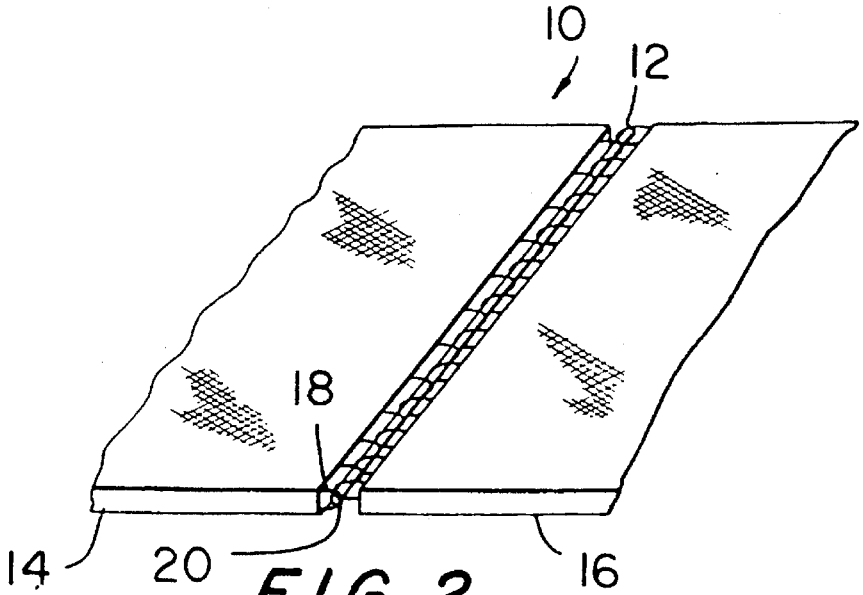
FIG. 2 is an enlarged schematic view of a pin seam.

FIG. 2 is a schematic view of a pin seam. The seam 12 is formed by bringing the left end 14 and the right end 16 of the papermaker's fabric 10 into close relative positions in which the seaming loops 18 at each end of the fabric 10 are alternated and intermeshed to produce a tubular passage. A pintle 20 is inserted down this passage to form and to close the pin seam 12.

The schematic view presented in FIG. 2 cannot adequately convey the difficulty of the task of inserting the pintle 20. Papermachine fabrics can be quite thick, stiff and bulky. The two ends must somehow be held closely together in order to join them with a pin seam. The wider the fabric, the more difficult it is to insert the pintle 20 through the alternating and intermeshed (or interdigitated) loops 18. Papermaker's fabric can be on the order of 10 meters wide. One can therefore readily appreciate the difficulty of inserting a pintle through a tubular passage, formed by interdigitated loops of yarn, of such a length.

Typically, the pintle 20 is connected to a wire leader, which is first directed through the tubular passage, and then used to pull the pintle 20 through in the manner of a needle and thread.

Figure 3:
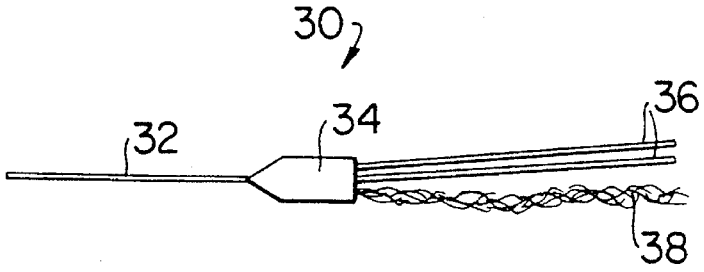
FIG. 3 is a plan view of a first embodiment of the composite pintle of the present invention.

FIG. 3 is a plan view of a first embodiment of the composite pintle of the present invention. Composite pintle 30 includes a wire leader 32 and a connecting sleeve 34, which joins one or more monofilament strands 36 to the wire leader 32 as well as one or more filler yarns 38. The latter includes staple fibers and may be a texturized, spun, cabled or plied yarn.

Figure 4:
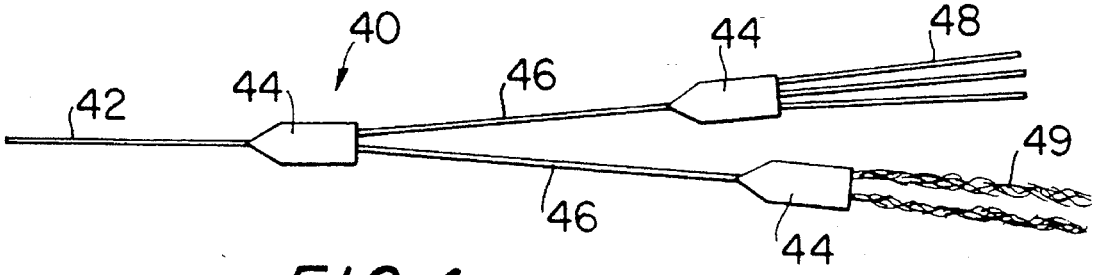
FIG. 4 is a plan view of a second embodiment thereof.

In a second embodiment shown in FIG. 4, the composite pintle 40 again includes a wire leader 42, but also includes three connecting sleeves 44 and two secondary wire leaders 46. One connecting sleeve 44 joins wire leader 42 to the two secondary wire leaders 46. In turn, each of the two secondary wire leaders 46 has its own connecting sleeve 44. To one is connected one or more monofilament strands 48, while to the other is connected one or more filler yarns 49 of the type described above. The two secondary wire leaders 46 may be of different length, so that the connecting sleeves 44 to which the monofilament strands 48 and filler yarns 49 are joined may not be laterally next to one another.

Figure 5:
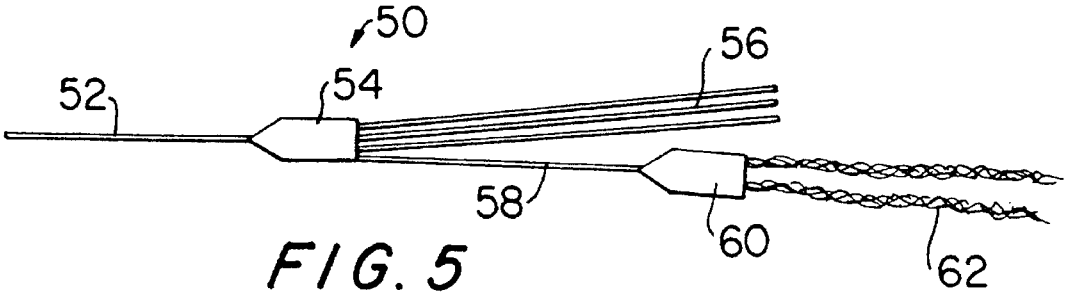
FIG. 5 is a plan view of a third embodiment of the composite pintle.

Finally, in a third embodiment shown in FIG. 5, the composite pintle 50 includes a wire leader 52 and a connecting sleeve 54, to which are attached one or more monofilament strands 56 and a secondary wire leader 58. At the other end of secondary leader 58 is another connecting sleeve 60, to which is attached one or more filler yarns 62.

In all embodiments, the connecting sleeves 34, 44, 54, 60 may be swage sleeves, which are hollow metal cores, one end of which is attached to the wire leader and the other end of which is attached to the yarns serving as the pintle and/or the filler yarns.

The composite pintles of the present invention incorporate in one structure the functional monofilament pintle and a filler yarn, and permit both of these to be installed in a pin seam simultaneously. This prevents the accidental loss of the filler yarn during installation, a situation frequently occurring when the filler yarn is installed separately. Perhaps more importantly, the present composite pintles prevent damage to the seam loops by eliminating the need to feed a second leader and connector through the passage formed by the joined fabric loops already occupied by a main functional pintle.

Modifications to the above would be obvious to those of ordinary skill in the art to which the present invention relates without departing from the scope of the appended claims.

What is claimed is:

1. A composite pintle for joining the ends of a pin-seamable papermaker's fabric to one another with a pin seam, said composite pintle comprising:

a first pintle member, said first pintle member being a monofilament yarn comprising at least one monofilament strand;

a second pintle member, said second pintle member being a filler yarn;

a wire leader; and a first, a second and a third connecting sleeve and a first and a second secondary wire leaders, said first connecting sleeve joining said first and second secondary wire leaders to said wire leader, said second connecting sleeve joining said first pintle member to said first secondary wire leader, and said third connecting sleeve joining said second pintle member to said second secondary wire leader.

2. A composite pintle for joining the ends of a pin-seamable papermaker's fabric to one another with a pin seam, said composite pintle comprising:

a first pintle member, said first pintle member being a monofilament yarn comprising at least one monofilament strand;

a second pintle member, said second pintle member being a filler yarn;

a wire leader; and a first and a second connecting sleeve and a secondary wire leader, said first connecting sleeve joining one of said first and second pintle members and said secondary wire leader to said wire leader, and said second connecting sleeve joining the other of said first and second pintle members to said secondary wire leader.

3. A composite pintle as claimed in claim 1 wherein said first and second secondary wire leaders are of unequal length.

4. A composite pintle as claimed in claim 1 or claim 2 wherein said first pintle member is a single monofilament strand.

5. A composite pintle as claimed in claim 1 or claim 2 wherein said first pintle member comprises a plurality of monofilament strands.

6. A composite pintle as claimed in claim 1 or claim 2 wherein said first pintle member is a plied monofilament yarn.

7. A composite pintle as claimed in claim 1 or claim 2 wherein said second pintle member is a texturized yarn.

8. A composite pintle as claimed in claim 1 or claim 2 wherein said second pintle member is a spun yarn.

9. A composite pintle as claimed in claim 1 or claim 2 wherein said second pintle member is a cabled yarn.

10. A composite pintle as claimed in claim 1 or claim 2 wherein said second pintle member is a plied yarn.

* * * * *